US012779300B2

(12) United States Patent
Whitney et al.

(10) Patent No.: US 12,779,300 B2
(45) Date of Patent: Nov. 3, 2026

(54) CLEAR LACROSSE HEAD

(71) Applicant: EAST COAST DYES, INC., Towson, MD (US)

(72) Inventors: Hamilton Sean Michael Whitney, Towson, MD (US); Andrew Dirks, Towson, MD (US); Keith McKinley, Towson, MD (US)

(73) Assignee: EAST COAST DYES, INC., Towson, MD (US)

( * ) Notice: Subject to any disclaimer, the term of this patent is extended or adjusted under 35 U.S.C. 154(b) by 472 days.

(21) Appl. No.: 17/491,627

(22) Filed: Oct. 1, 2021

(65) Prior Publication Data

US 2022/0203189 A1 Jun. 30, 2022

Related U.S. Application Data

(63) Continuation-in-part of application No. 17/136,165, filed on Dec. 29, 2020.

(51) Int. Cl.
*A63B 59/20* (2015.01)
*A63B 102/14* (2015.01)

(52) U.S. Cl.
CPC ..... *A63B 59/20* (2015.10); *A63B 2102/14* (2015.10)

(58) Field of Classification Search
CPC ..... A63B 59/20; A63B 2102/14; A63B 60/08; A63B 2209/00; A63B 49/10; B29C 70/00; B32B 5/00; C08J 5/00
See application file for complete search history.

(56) References Cited

U.S. PATENT DOCUMENTS 3,507,495 A * 4/1970 Fracalossi ..... A63B 59/20 264/331.19
3,873,094 A 3/1975 Sebo et al.
4,222,566 A * 9/1980 Berry ..... A63B 53/04 473/250
4,546,147 A 10/1985 Woodbrey et al.
4,643,857 A 2/1987 Cousin et al.
4,913,638 A * 4/1990 Buja ..... B29C 45/80 425/149
5,044,924 A * 9/1991 Loren ..... B29C 45/1734 264/572
5,118,455 A * 6/1992 Loren ..... B29C 45/1732 264/328.13
5,204,050 A * 4/1993 Loren ..... B29C 45/1704 264/572

(Continued)

FOREIGN PATENT DOCUMENTS

AU 2003204425 A1 * 1/2004 ..... B29D 12/02
CA 2727209 C * 2/2014 ..... B29C 45/0013

(Continued)

OTHER PUBLICATIONS

CN 105936732 A (Year: 2016).*
Office Action issued Mar. 15, 2022 in US Appl. No. 17/136, 165.

*Primary Examiner* — John E Simms, Jr.
*Assistant Examiner* — Amir A Klayman
(74) *Attorney, Agent, or Firm* — MEDLER FERRO WOODHOUSE & MILLS PLLC

(57) ABSTRACT

The invention relates in general to lacrosse heads, and more particularly to preparation of a lacrosse head that is optically clear, but still maintains the desired stiffness and durability characteristics for optimal play.

8 Claims, 12 Drawing Sheets

(56) References Cited

U.S. PATENT DOCUMENTS 5,566,743 A * 10/1996 Guergov ..... B29C 33/10 164/113
5,899,818 A 5/1999 Zider et al.
5,964,669 A * 10/1999 Bloomer ..... A63B 53/0487 473/250
6,042,354 A * 3/2000 Loren ..... B29C 45/1734 264/572
7,062,829 B2 6/2006 Perez
7,771,289 B2 8/2010 Palumbo et al.
8,282,512 B1 * 10/2012 Winningham ..... A63B 59/20 D21/724
8,827,848 B1 9/2014 Washburn et al.
9,050,505 B2 6/2015 Bond et al.
9,205,302 B2 * 12/2015 Kim ..... A63B 37/0003
9,227,116 B2 1/2016 Cynn
11,090,538 B2 8/2021 Whitney et al.
2004/0072637 A1 4/2004 Morrow et al.
2006/0019768 A1 1/2006 Lo
2006/0040762 A1 2/2006 Chupka et al.
2008/0026884 A1 * 1/2008 Morrow ..... A63B 59/20 29/433
2008/0176669 A1 7/2008 Spencer et al.
2008/0277839 A1 * 11/2008 Smith ..... B29C 45/1704 264/513
2009/0159451 A1 6/2009 Tomantschger et al.
2010/0260955 A1 10/2010 Hasegawa et al.
2011/0053705 A1 3/2011 Stites
2011/0152001 A1 * 6/2011 Hirano ..... A63B 53/0466 473/335
2012/0034990 A1 2/2012 Cohen et al.
2012/0169869 A1 7/2012 You et al.
2012/0214929 A1 * 8/2012 Fishburn ..... C08L 71/12 524/505
2012/0237789 A1 9/2012 Wang et al.
2012/0302382 A1 11/2012 Bond et al.
2013/0040767 A1 2/2013 Gill
2014/0162809 A1 6/2014 Soracco
2014/0221134 A1 8/2014 Giegerich et al.
2014/0335979 A1 11/2014 Grimes
2016/0046807 A1 * 2/2016 Adur ..... C08L 77/06 525/71
2016/0199710 A1 7/2016 Barnhart
2016/0311391 A1 * 10/2016 Twork ..... B60R 21/215
2017/0028959 A1 * 2/2017 Twork ..... B60R 21/2165
2017/0165532 A1 6/2017 Khan et al.
2017/0175309 A1 6/2017 Van Loon III
2018/0185722 A1 * 7/2018 Miceli ..... B29C 33/30
2018/0347023 A1 12/2018 Ma et al.
2019/0001200 A1 * 1/2019 Àwengen ..... A63B 53/007
2019/0009153 A1 * 1/2019 Morrow ..... D04B 1/22
2020/0188749 A1 6/2020 Whitney
2021/0252356 A1 8/2021 Thurman et al.
2021/0375019 A1 * 12/2021 Miceli ..... G06T 11/001

FOREIGN PATENT DOCUMENTS

CA 2987189 A1 * 6/2018 ..... B29B 9/12
CN 105936732 A * 9/2016
EP 0733668 A2 * 9/1996

* cited by examiner

| Insert | Run | Color | Material | ID Number | Date of Manufacturing | Date Tested | Weight @ Testing (g) | 20° WTS Stiffness Check (psi) 120 °F | 130 °F | 140 °F | 150 °F | 160 °F | Result | Location | Burst (Y/N) | Burst Break Location Left | Left | Right | Right | Front | Front | Back | Back | Notes |
|---|---|---|---|---|---|---|---|---|---|---|---|---|---|---|---|---|---|---|---|---|---|---|---|---|
| DMA | Trial | Clear | Grilamid TR 4863 Blue | 20-399 | 9/3/2020 | 9/9/2020 | 139.9 | 23.6 | 24.5 | 26.3 | 27.6 | 28.3 | 260 | Rail (Vent) | -- | -- | - | - | - | - | - | - | - | -- |
| DMA | Trial | Clear | Grilamid TR 4863 Blue | 20-400 | 9/3/2020 | 9/9/2020 | 140.1 | -- | - | -- | -- | - | -- | -- | Fail | ✓ | ✓ | ✓ | ✓ | ✓ | ✓ | × | | Strut |
| DMA | Trial | Clear | Grilamid TR 4863 Blue | 20-401 | 9/3/2020 | 9/9/2020 | 140.2 | -- | - | -- | -- | - | -- | -- | Pass | ✓ | ✓ | ✓ | ✓ | ✓ | ✓ | ✓ | ✓ | |
| DMA | Trial | Clear | Grilamid TR 4863 Blue | 20-402 | 9/3/2020 | 9/9/2020 | 140.1 | -- | - | -- | -- | - | -- | -- | Fail | ✓ | ✓ | ✓ | ✓ | ✓ | ✓ | × | | Strut |
| DMA | Trial | Clear | Grilamid TR 4863 Blue | 20-403 | 9/3/2020 | 9/9/2020 | 140.1 | -- | - | -- | -- | - | -- | -- | Fail | ✓ | ✓ | ✓ | ✓ | ✓ | ✓ | × | | Strut |
| DMA | Trial | Clear | Grilamid TR 4863 Blue | 20-404 | 9/3/2020 | 9/9/2020 | 140 | -- | - | -- | -- | - | -- | -- | Pass | ✓ | ✓ | ✓ | ✓ | ✓ | ✓ | ✓ | ✓ | |
| DMA Diamond | PPAP #1 & 2 | Clear | Grilamid TR 4863 Blue | 20-472 | 10/22/2020 | 10/23/2020 | 145.8 | -- | - | 26.4 | -- | - | 295 | Rail | -- | -- | - | - | - | - | - | - | - | -- |
| DMA Diamond | PPAP #1 & 2 | Clear | Grilamid TR 4863 Blue | 20-473 | 10/22/2020 | 10/23/2020 | 145.3 | -- | - | 27.4 | -- | - | -- | -- | Pass | ✓ | ✓ | ✓ | ✓ | ✓ | ✓ | ✓ | ✓ | -- |
| DMA Diamond | PPAP #1 & 2 | Clear | Grilamid TR 4863 Blue | 20-474 | 10/22/2020 | 10/23/2020 | 145.8 | -- | - | -- | -- | - | -- | -- | Pass | ✓ | ✓ | ✓ | ✓ | ✓ | ✓ | ✓ | ✓ | -- |
| DMA Diamond | PPAP #1 & 2 | Clear | Grilamid TR 4863 Blue | 20-475 | 10/22/2020 | 10/23/2020 | 145.9 | -- | - | -- | -- | - | -- | -- | Pass | ✓ | ✓ | ✓ | ✓ | ✓ | ✓ | ✓ | ✓ | -- |
| DMA Diamond | PPAP #1 & 2 | Clear | Grilamid TR 4863 Blue | 20-476 | 10/22/2020 | 10/23/2020 | 145.9 | -- | - | -- | -- | - | -- | -- | Pass | ✓ | ✓ | ✓ | ✓ | ✓ | ✓ | ✓ | ✓ | -- |
| DMA Diamond | PPAP #1 & 2 | Clear | Grilamid TR 4863 Blue | 20-477 | 10/22/2020 | 10/23/2020 | 145.9 | -- | - | -- | -- | - | -- | -- | Pass | ✓ | ✓ | ✓ | ✓ | ✓ | ✓ | ✓ | ✓ | -- |
| DMA Diamond | PPAP #1 & 2 | Clear | Grilamid TR 4863 Blue | 20-478 | 10/22/2020 | 10/23/2020 | 145.9 | -- | - | -- | -- | - | -- | -- | Pass | ✓ | ✓ | ✓ | ✓ | ✓ | ✓ | ✓ | ✓ | -- |
| DMA Diamond | PPAP #1 & 3 | Clear | Grilamid TR 4863 Blue | 20-465 | 10/22/2020 | 10/23/2020 | 147.4 | -- | - | 28.0 | -- | - | 295 | Rail | -- | -- | - | - | - | - | - | - | - | -- |
| DMA Diamond | PPAP #1 & 3 | Clear | Grilamid TR 4863 Blue | 20-466 | 10/22/2020 | 10/23/2020 | 147.3 | -- | - | 28.8 | -- | - | -- | -- | Pass | ✓ | ✓ | ✓ | ✓ | ✓ | ✓ | ✓ | ✓ | -- |
| DMA Diamond | PPAP #1 & 3 | Clear | Grilamid TR 4863 Blue | 20-467 | 10/22/2020 | 10/23/2020 | 147.2 | -- | - | -- | -- | - | -- | -- | Pass | ✓ | ✓ | ✓ | ✓ | ✓ | ✓ | ✓ | ✓ | -- |
| DMA Diamond | PPAP #1 & 3 | Clear | Grilamid TR 4863 Blue | 20-468 | 10/22/2020 | 10/23/2020 | 147.3 | -- | - | -- | -- | - | -- | -- | Pass | ✓ | ✓ | ✓ | ✓ | ✓ | ✓ | ✓ | ✓ | -- |
| DMA Diamond | PPAP #1 & 3 | Clear | Grilamid TR 4863 Blue | 20-469 | 10/22/2020 | 10/23/2020 | 146.8 | -- | - | -- | -- | - | -- | -- | Pass | ✓ | ✓ | ✓ | ✓ | ✓ | ✓ | ✓ | ✓ | -- |
| DMA Diamond | PPAP #1 & 3 | Clear | Grilamid TR 4863 Blue | 20-470 | 10/22/2020 | 10/23/2020 | 147.3 | -- | - | -- | -- | - | -- | -- | Pass | ✓ | ✓ | ✓ | ✓ | ✓ | ✓ | ✓ | ✓ | -- |
| DMA Diamond | PPAP #1 & 3 | Clear | Grilamid TR 4863 Blue | 20-471 | 10/22/2020 | 10/23/2020 | 147.1 | -- | - | -- | -- | - | -- | -- | Pass | ✓ | ✓ | ✓ | ✓ | ✓ | ✓ | ✓ | ✓ | -- |
| DMA Diamond | Pilot | Clear | Grilamid TR 4863 Blue | 20-485 | 10/26/2020 | 10/28/2020 | 145.8 | -- | - | 28.6 | -- | - | 300 | Small break in casing string hole | | | | | | | | | | |
| DMA Diamond | Pilot | Clear | Grilamid TR 4863 Blue | 20-486 | 10/26/2020 | 10/28/2020 | 145.8 | -- | - | 28.5 | -- | - | -- | -- | Pass | ✓ | ✓ | ✓ | ✓ | ✓ | ✓ | ✓ | ✓ | -- |
| DMA Diamond | Pilot | Clear | Grilamid TR 4863 Blue | 20-487 | 10/26/2020 | 10/28/2020 | 145.7 | -- | - | -- | -- | - | -- | -- | Pass | ✓ | ✓ | ✓ | ✓ | ✓ | ✓ | ✓ | ✓ | -- |
| DMA Diamond | Pilot | Clear | Grilamid TR 4863 Blue | 20-488 | 10/26/2020 | 10/28/2020 | 145.7 | -- | - | -- | -- | - | -- | -- | Pass | ✓ | ✓ | ✓ | ✓ | ✓ | ✓ | ✓ | ✓ | -- |
| DMA Diamond | Pilot | Clear | Grilamid TR 4863 Blue | 20-489 | 10/26/2020 | 10/28/2020 | 145.7 | -- | - | -- | -- | - | -- | -- | Fail | ✓ | ✓ | ✓ | ✓ | ✓ | ✓ | ✓ | × | Thread |
| DMA Diamond | Pilot | Clear | Grilamid TR 4863 Blue | 20-490 | 10/26/2020 | 10/28/2020 | 145.8 | -- | - | -- | -- | - | -- | -- | Pass | ✓ | ✓ | ✓ | ✓ | ✓ | ✓ | ✓ | ✓ | -- |
| DMA Diamond | Pilot | Clear | Grilamid TR 4863 Blue | 20-491 | 10/26/2020 | 10/28/2020 | 145.8 | -- | - | -- | -- | - | -- | -- | Pass | ✓ | ✓ | ✓ | ✓ | ✓ | ✓ | ✓ | ✓ | -- |
| DMA Diamond | Pilot | Clear | Grilamid TR 4863 Blue | 20-492 | 10/26/2020 | 10/28/2020 | 145.8 | -- | - | -- | -- | - | -- | -- | Pass | ✓ | ✓ | ✓ | ✓ | ✓ | ✓ | ✓ | ✓ | -- |
| DMA Diamond | Pilot | Clear | Grilamid TR 4863 Blue | 20-493 | 10/26/2020 | 10/28/2020 | 145.7 | -- | - | -- | -- | - | -- | -- | Pass | ✓ | ✓ | ✓ | ✓ | ✓ | ✓ | ✓ | ✓ | -- |
| DMA Diamond | Pilot | Clear | Grilamid TR 4863 Blue | 20-494 | 10/26/2020 | 10/28/2020 | 145.7 | -- | - | -- | -- | - | -- | -- | Pass | ✓ | ✓ | ✓ | ✓ | ✓ | ✓ | ✓ | ✓ | -- |
| DMA Diamond | Pilot | Clear | Grilamid TR 4863 Blue | 20-495 | 10/26/2020 | 10/28/2020 | 145.7 | -- | - | -- | -- | - | -- | -- | Pass | ✓ | ✓ | ✓ | ✓ | ✓ | ✓ | ✓ | ✓ | -- |
| DMA Diamond | Pilot | Clear | Grilamid TR 4863 Blue | 20-496 | 10/26/2020 | 10/28/2020 | 145.6 | -- | - | -- | -- | - | -- | -- | Pass | ✓ | ✓ | ✓ | ✓ | ✓ | ✓ | ✓ | ✓ | -- |

FIG. 5

FIG. 6

| Model | Run | Color | Material | ECO Number # | Date of Manufacturing | Date Tested | Weight @ Free Leg (g) | 20°: MFS Difference Check (lbs) | | | | | TAGER 36 | | Bath (Color) | Bath Bends Location | | | | | | | |
|---|---|---|---|---|---|---|---|---|---|---|---|---|---|---|---|---|---|---|---|---|---|---|---|
| | | | | | | | | 12°F | 20°F | 25°F | 32°F | 37°F | Results | Location | | Left | Left | Right | Right | Front | Front | Back | Back |
| Infinity | Trial | Clear | Grilamid TR 48G Blue | 20-417 | 8/10/2020 | 8/10/2020 | 124 | 14.4 | 14.8 | 16.2 | 17 | 17.6 | 75 lbs | Lens Bad | -- | -- | -- | -- | -- | -- | -- | -- | -- |
| Infinity | Trial | Clear | Grilamid TR 48G Blue | 20-418 | 8/10/2020 | 8/10/2020 | 124.1 | -- | -- | -- | -- | -- | -- | -- | Pass | ✓ | ✓ | ✓ | ✓ | ✓ | ✓ | ✓ | ✓ |
| Infinity | Trial | Clear | Grilamid TR 48G Blue | 20-419 | 8/10/2020 | 8/10/2020 | 124.1 | -- | -- | -- | -- | -- | -- | -- | Pass | ✓ | ✓ | ✓ | ✓ | ✓ | ✓ | ✓ | ✓ |
| Infinity | Trial | Clear | Grilamid TR 48G Blue | 20-420 | 8/10/2020 | 8/10/2020 | 124.2 | -- | -- | -- | -- | -- | -- | -- | Pass | ✓ | ✓ | ✓ | ✓ | ✓ | ✓ | ✓ | ✓ |
| Infinity | Trial | Clear | Grilamid TR 48G Blue | 20-421 | 8/10/2020 | 8/10/2020 | 124.2 | -- | -- | -- | -- | -- | -- | -- | Pass | ✓ | ✓ | ✓ | ✓ | ✓ | ✓ | ✓ | ✓ |
| Infinity | Trial | Clear | Grilamid TR 48G Blue | 20-422 | 8/10/2020 | 8/10/2020 | 124.2 | -- | -- | -- | -- | -- | -- | -- | Pass | ✓ | ✓ | ✓ | ✓ | ✓ | ✓ | ✓ | ✓ |

FIG. 7

| Head | Type | Material | ECO Sample # | Color | Weight @ Test (g) | Date Tested | 25° - MTS Stiffness Check (lbf) | | | | | Thor XL | | Bash Test | Test Location | | | | | | | | Break Location |
|---|---|---|---|---|---|---|---|---|---|---|---|---|---|---|---|---|---|---|---|---|---|---|---|
| | | | | | | | 125°F | 105°F | 72°F | 32°F | 5°F | Result | Location | Result | Left | Left | Right | Right | Front | Front | Back | Back | |
| DNA | Trial | Resmart Ultra PC MF 10 UV | 20-207 | Clear | 169.5 | 4/6/2020 | 38.7 | 38.3 | 41.7 | 49 | 49.9 | Fail | 90 Hits | - | - | - | - | - | - | - | - | - | - |
| DNA | Trial | Resmart Ultra PC MF 10 UV | 20-208 | Clear | 169.3 | 4/6/2020 | - | - | 41.7 | - | - | - | - | Pass | ✓ | ✓ | ✓ | ✓ | ✓ | ✓ | ✓ | ✓ | None |
| DNA | Trial | Resmart Ultra PC MF 10 UV | 20-209 | Clear | 169.6 | 4/6/2020 | - | - | 41.7 | - | - | - | - | Fail | ✓ | ✓ | ✓ | ✓ | ✓ | ✓ | × | | Left Rail |
| DNA | Trial | Resmart Ultra PC MF 10 UV | 20-210 | Clear | 169.6 | 4/6/2020 | - | - | - | - | - | - | - | Fail | ✓ | ✓ | ✓ | ✓ | ✓ | ✓ | × | | Left Rail |
| DNA | Trial | Resmart Ultra PC MF 10 UV | 20-211 | Clear | 169.5 | 4/6/2020 | - | - | - | - | - | - | - | Fail | ✓ | ✓ | ✓ | ✓ | ✓ | ✓ | × | | Left Rail |
| DNA | Trial | Resmart Ultra PC MF 10 UV | 20-212 | Clear | 169.3 | 4/6/2020 | - | - | - | - | - | - | - | Pass | ✓ | ✓ | ✓ | ✓ | ✓ | ✓ | ✓ | ✓ | None |
| DNA | Trial | Resmart Ultra PC MF 10 UV | 20-213 | Clear | 169.4 | 4/6/2020 | - | - | - | - | - | - | - | Pass | ✓ | ✓ | ✓ | ✓ | ✓ | ✓ | ✓ | ✓ | None |
| DNA | Trial | Resmart Ultra PC MF 10 UV | 20-214 | Clear | 169.5 | 4/6/2020 | - | - | - | - | - | - | - | Pass | ✓ | ✓ | ✓ | ✓ | ✓ | ✓ | ✓ | ✓ | None |

FIG. 9

| Head | Run | Material | ECD # | DAM Weight (g) | Weight @ Testing (g) | Date of Manufacturing | Date Tested | .35"- MTS Stiffness Check (lbf) | | | | | THOR XL | | Bash (Cold) | Bash Break Location | | | | | | | | Notes |
|---|---|---|---|---|---|---|---|---|---|---|---|---|---|---|---|---|---|---|---|---|---|---|---|---|
| | | | | | | | | 122°F | 105°F | 72°F | 32°F | 5°F | Result | Location | | Left | Left | Right | Right | Front | Front | Back | Back | |
| Infinity | Trial | Ultra PC | -- | -- | 147.9 | -- | -- | | | | | | <10 Hz | Lower Rail | | | | | | | | | | |
| Infinity | Trial | Ultra PC | -- | -- | 147.8 | -- | -- | | | | | | | | Pass | ✓ | ✓ | ✓ | ✓ | ✓ | ✓ | ✓ | ✓ | |
| Infinity | Trial | Ultra PC | -- | -- | 147.9 | -- | -- | 23.7 | 24.4 | 27 | 27 | 27.9 | | | | | | | | | | | | |

FIG. 10

CLEAR LACROSSE HEAD

CROSS-REFERENCE TO RELATED APPLICATIONS

The present application is a continuation-in-part of U.S. application Ser. No. 17/136,165, filed Dec. 29, 2020, the disclosure of which is incorporated by reference herein in its entirety.

FIELD OF THE INVENTION

The invention relates in general to lacrosse heads, and more particularly to preparation of a lacrosse head that is optically clear, but still maintains the desired stiffness and durability characteristics for optimal play.

BACKGROUND OF THE INVENTION

Double-walled, synthetic lacrosse heads have revolutionized the game of lacrosse. The synthetic heads impart a lightness, maneuverability, and flexibility. These performance advantages greatly enhance players' skills and have increased the speed of the game.

In combination with qualities that enhance the skill of the game, many players desire unique esthetic characteristics, such as lacrosse heads that are optically clear, or translucent. However, obtaining such esthetic characteristics, while also maintaining the desired mechanical characteristics for optical play, has not yet been achieved.

BRIEF SUMMARY OF THE INVENTION

The present invention fulfills these needs by providing lacrosse heads that are optically clear, or translucent, but also have the desired mechanical characteristics for optical play.

Embodiments hereof are directed to a lacrosse head comprising opposing sidewalls joined at one end by a throat, the sidewalls diverging generally outwardly, and the sidewalls being connected at another end by a scoop, wherein the lacrosse head comprises a nylon polymer that exhibits greater than 60% light transmission.

In further embodiments, provided herein is a lacrosse head comprising opposing sidewalls joined at one end by a throat, the sidewalls diverging generally outwardly, and the sidewalls being connected at another end by a scoop, wherein the lacrosse head comprises a polymer that exhibits greater than 60% light transmission, and wherein the lacrosse head has a weight of about 110 g to about 150 g, a stiffness of about 20 lbf to about 35 lbf when measured at a temperature between 70° F.-75° F., and wherein the lacrosse head can withstand more than 150 impacts prior to failure, wherein the lacrosse head has attained a kinetic energy of about 25 Joules to about 55 Joules prior to each impact, or wherein the lacrosse head has a weight of about 100 g to about 125 g, a stiffness of about 5 lbf to about 20 lbf when measured at a temperature between 70° F.-75°, and wherein the lacrosse head can withstand more than 20 impacts prior to failure, wherein the lacrosse head has attained a kinetic energy of about 25 Joules to about 55 Joules prior to each impact.

In additional embodiments, provided herein is a lacrosse head comprising opposing sidewalls joined at one end by a throat, the sidewalls diverging generally outwardly, and the sidewalls being connected at another end by a scoop, wherein the lacrosse head comprises a nylon polymer that exhibits about 15% to about 50% light transmission, and wherein the lacrosse head has a weight of about 100 g to about 150 g, a stiffness of about 20 lbf to about 35 lbf when measured at a temperature between 70° F.-75° F., and wherein the lacrosse head can withstand more than 150 impacts prior to failure, wherein the lacrosse head has attained a kinetic energy of about 25 Joules to about 55 Joules prior to each impact, or wherein the lacrosse head has a weight of about 100 g to about 125 g, a stiffness of about 5 lbf to about 20 lbf when measured at a temperature between 70° F.-75°, and wherein the lacrosse head can withstand more than 20 impacts prior to failure, wherein the lacrosse head has attained a kinetic energy of about 25 Joules to about 55 Joules prior to each impact.

Also provided herein is a lacrosse head comprising opposing sidewalls joined at one end by a throat, the sidewalls diverging generally outwardly, and the sidewalls being connected at another end by a scoop, wherein the lacrosse head comprises an impact modified nylon 12 polymer that exhibits greater than 75% light transmission, and wherein the lacrosse head has a weight of less than 150 g, a stiffness of less than 30.0 lbf when measured at a temperature between 70° F.-75° F., and wherein the lacrosse head can withstand more than 250 impacts prior to failure, wherein the lacrosse head has attained a kinetic energy of about 25 Joules to about 55 Joules prior to each impact.

In further embodiments, provided herein is a lacrosse head comprising: opposing sidewalls joined at one end by a throat, the sidewalls diverging generally outwardly, and the sidewalls being connected at another end by a scoop, wherein the lacrosse head comprises a polymer that exhibits greater than 60% light transmission, and wherein the lacrosse head has a weight of about 250 g to about 350 g, a stiffness of about 8 lbf to about 20 lbf when measured at a temperature between 70° F.-75° F., and wherein the lacrosse head can withstand more than 10 impacts prior to failure, wherein the lacrosse head has attained a kinetic energy of about 25 Joules to about 55 Joules prior to each impact.

BRIEF DESCRIPTION OF DRAWINGS

The foregoing and other features and advantages of the invention will be apparent from the following description of embodiments hereof as illustrated in the accompanying drawings. The accompanying drawings, which are incorporated herein and form a part of the specification, further serve to explain the principles of the invention and to enable a person skilled in the pertinent art to make and use the invention. The drawings are not to scale.

FIG. 5 shows the results of mechanical testing of a DNA lacrosse head in accordance with embodiments hereof.

FIG. 6 shows the results of mechanical testing of a Mirage 2 lacrosse head in accordance with embodiments hereof.

FIG. 7 shows the results of mechanical testing of an Infinity lacrosse head in accordance with embodiments hereof.

FIG. 9 shows the results of mechanical testing of a polycarbonate optically clear material in a DNA lacrosse head geometry.

FIG. 10 shows the results of mechanical testing of a polycarbonate optically clear material in an infinity lacrosse head geometry.

DETAILED DESCRIPTION OF THE INVENTION

Specific embodiments of the present invention are now described with reference to the figures, wherein like reference numbers indicate identical or functionally similar elements. The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1:
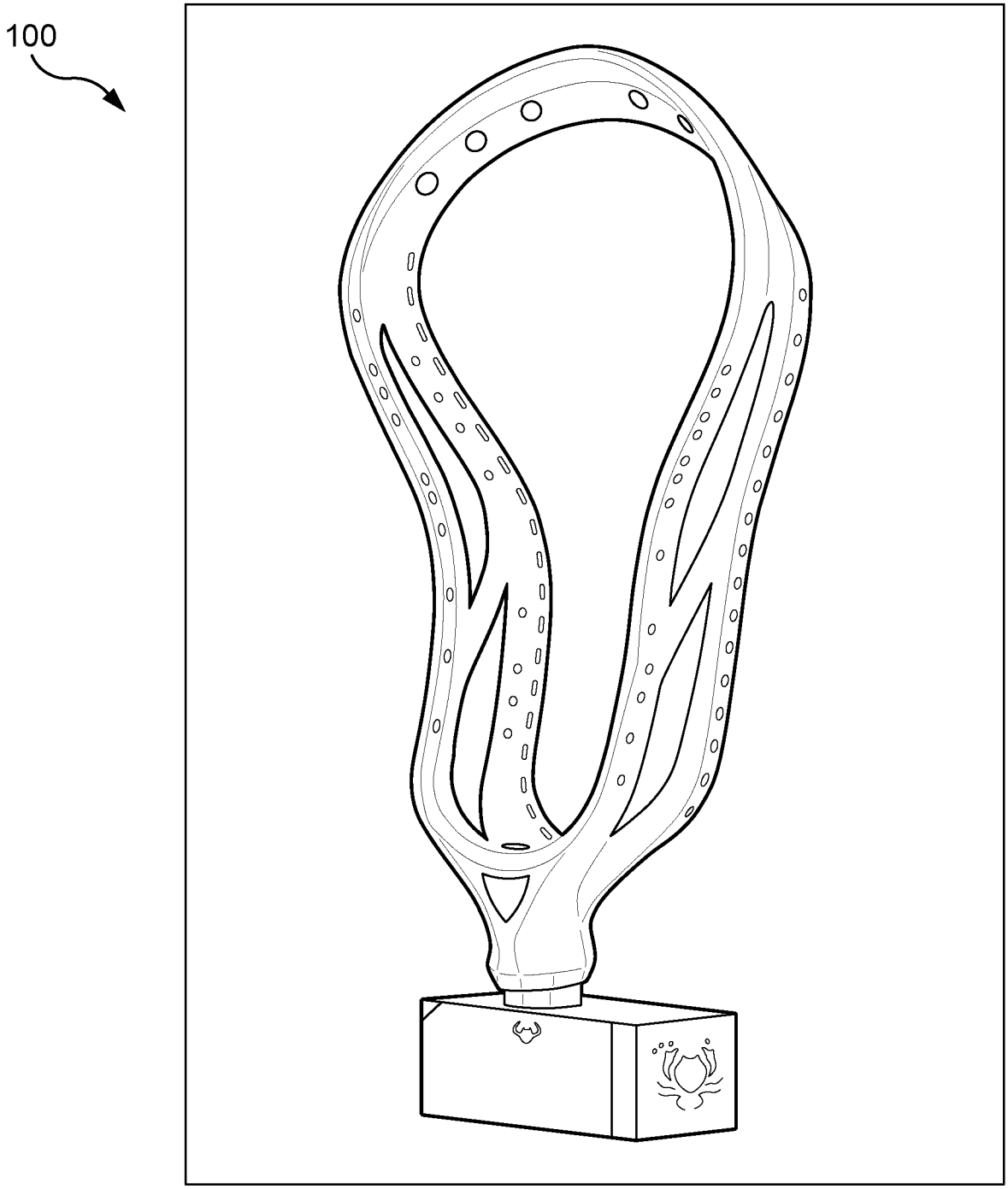
FIG. 1 shows an exemplary lacrosse head according to embodiments hereof.

Embodiments hereof relate to a lacrosse head that is optically clear or translucent, providing a unique esthetic experience for the player, in comparison to traditional lacrosse heads that are prepared from plastics that do not provide any light transmission. FIG. 1 shows an exemplary lacrosse head 100 that is optically clear. As used herein, "optically clear" means that the material that is used to make the lacrosse head exhibits a light transmission of greater than 60%. The terms "optically clear," "clear," "optically transparent," and "transparent" are used interchangeably herein. In other embodiments, a lacrosse head is "translucent." As used herein, "translucent" means that the material used to make the lacrosse head exhibits a light transmission of about 10% to about 60%, and includes materials that contain a tint or coloring, but otherwise allow for the specified amount of light transmission.

As used herein, "about" when used to modify a numeric value, covers a range on either side of the numeric value of ±10%.

Figure 2:
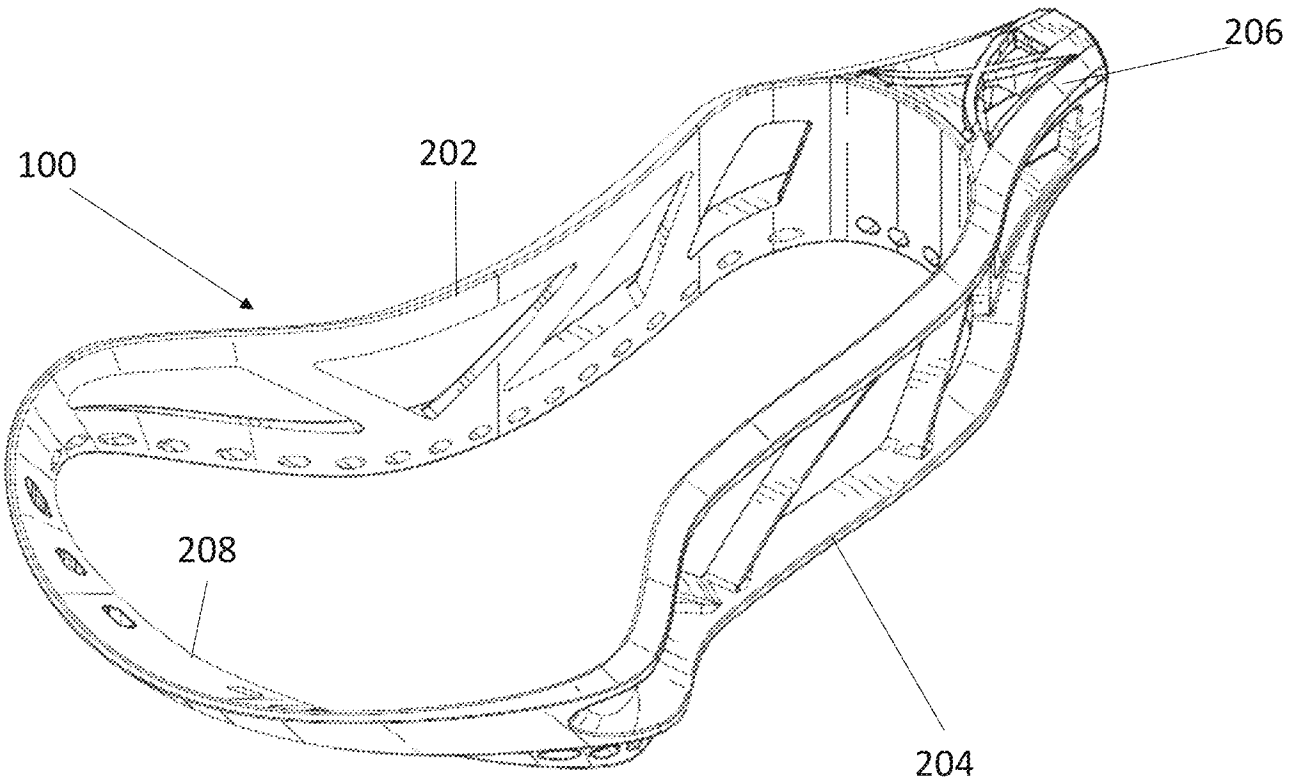
FIG. 2 is a perspective view of a lacrosse head according to embodiments hereof.

FIG. 2 shows a line drawing of lacrosse head 100, showing the location of opposing sidewalls (202 and 204) joined at one end by a throat 206, the sidewalls diverging generally outwardly, and the sidewalls being connected at another end by a scoop 208. The diagram of lacrosse head 100 in FIG. 2 is not meant to be limiting, and is provided to illustrate the components of the lacrosse head, but is not meant to imply any design or specific features of the lacrosse head, other than those described herein. The materials described herein can be utilized in any design or configuration of a lacrosse head.

In embodiments, provided herein is a lacrosse head comprising opposing sidewalls (202 and 204) joined at one end by a throat (206), the sidewalls diverging generally outwardly, and the sidewalls being connected at another end by a scoop (208), wherein the lacrosse head comprises a polymer that exhibits greater than 60% light transmission.

Suitably, the polymer utilized in the lacrosse heads described herein is a nylon polymer. In exemplary embodiments, the nylon polymer is an impact modified nylon polymer, including an impact modified nylon 12 (IMPA 12), impact modified nylon 6, as well as combinations of nylon 6 and nylon 12 (i.e., nylon 6/12). Combinations of nylon 6/12, can be impact modified, but can also be utilized without impact modification. Nylon 12 has a formula $[(CH2)_{11}C(O)NH]_n$, and is made from ω-aminolauric acid or laurolactam monomers that each have 12 carbons, and has the following structure:

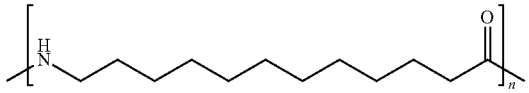

"Impact modified" refers to the addition of one or more additional polymers or monomers, or other impact modifiers, into the nylon 12, nylon 6, or nylon 6/12, to increase its durability and toughness.

In exemplary embodiments, the impact modified nylon 12 is a transparent thermoplastic polyamide based on aliphatic and cycloaliphatic monomers. In exemplary embodiments, the nylon 12 is GRILAMID® TR RDS 4863 from EMS-CHEMIE (Sumter, SC). Suitably the impact modified nylon 12 is GRILAMID® TR RDS 4863 Blue L 12309.01, having the following properties:

TABLE 1

Properties of GRILAMID* TR RDS 4863

| | | Standard | Unit | State | Grilamid TR RDS 4863 |
|---|---|---|---|---|---|
| Mechanical Properties | | | | | |
| Tensile E-Modulus | 1 mm/min | ISO 527 | MPa | cond. | 1400 |
| Tensile Strength at yield | 50 mm/min | ISO 527 | MPa | cond. | >50 |
| Elongation at yield | 5 mm/min | ISO 527 | % | cond. | 7 |
| Tensile Strength at break | 50 mm/min | ISO 527 | MPa | cond. | 50 |
| Elongation at break | 50 mm/min | ISO 527 | % | cond. | >50 |
| Impact strength | Charpy, 23° C. | ISO 179/2-1eU | $kJ/m^2$ | cond. | no break |
| Impact strength | Charpy, −30° C. | ISO 179/2-1eU | $kJ/m^2$ | cond. | no break |
| Notched Impact strength | Charpy, 23° C. | ISO 179/2-1eA | $kJ/m^2$ | cond. | 17 |
| Notched Impact strength | Charpy, −30° C. | ISO 179/2-1eA | $kJ/m^2$ | cond. | * |
| Thermal Properties | | | | | |
| Glass transition temperature | DSC | ISO 11357 | ° C. | dry | 150 |
| Heat deflection temperature HDT/A | 1.80 MPa | ISO 75 | ° C. | dry | 110 |
| Heat deflection temperature HDT/B | 0.35 MPa | ISO 75 | ° C. | dry | 135 |
| Maximum usage temperature | long term | ISO 2578 | ° C. | dry | 80-100 |
| Maximum usage temperature | short term | EMS | ° C. | dry | 120 |

TABLE 1-continued

| Properties of GRILAMID* TR RDS 4863 | | | | | |
|---|---|---|---|---|---|
| | | Standard | Unit | State | Grilamid TR RDS 4863 |
| Elektrical Properties | | | | | |
| Dielectric strength | | IEC 60243-1 | KV/mm | cond. | 34 |
| Comparative tracking index | CTI | IEC 60112 | — | cond. | 600 |
| Specific volume resistivity | | IEC 60093 | Ω · m | cond. | $10^{11}$ |
| Specific surface resistivity | | IEC 60093 | Ω | cond. | $10^{12}$ |
| General Properties | | | | | |
| Density | 23° C./sat. | ISO 1183 | g/cm$^3$ | dry | 1.00 |
| Water absorption | 23° C./50% r.h. | ISO 62 | % | — | 3.0 |
| Moisture absorption | 24 h/23° C. | ISO 62 | % | — | 1.5 |
| Linear mould shrinkage long | 24 h/23° C. | ISO 294 | % | dry | 1.05 |
| Linear mould shrinkage trans. | | ISO 294 | % | dry | 1.10 |

In additional embodiments, the nylon 12 can have the following mechanical properties:

TABLE 2

| Nylon 12 Mechanical Properties | | | | | |
|---|---|---|---|---|---|
| Tensile E-Modulus | 1 mm/min | ISO 527 | MPa | dry | 1500 |
| | | | | cond. | 1500 |
| Tensile strength at yield | 50 mm/min | ISO 527 | MPa | dry | 55 |
| | | | | cond. | 50 |
| Elongation at yield | 50 mm/min | ISO 527 | % | dry | 7.5 |
| | | | | cond. | 6.5 |
| Elongation at break | 50 mm/min | ISO 527 | % | dry | >50 |
| | | | | cond. | >50 |
| Impact strength | Charpy, 23° C. | ISO 179/2-1eU | kJ/m$^2$ | dry | no break |
| | | | | cond. | no break |
| Impact strength | Charpy, −30° C. | ISO 179/2-1eU | kJ/m$^2$ | dry | no break |
| | | | | cond. | no break |
| Notched impact strength | Charpy, 23° C. | ISO 179/2-1eA | kJ/m$^2$ | dry | 60 |
| | | | | cond. | 60 |
| Notched impact strength | Charpy, −30° C. | ISO 179/2-1eA | kJ/m$^2$ | dry | 15 |
| | | | | cond. | 15 |
| Shore hardness D | | ISO 868 | — | dry | 78 |
| | | | | cond. | 78 |
| Ball indentation hardness | | ISO 2039-1 | MPa | dry | 90 |
| | | | | cond. | 90 |

Examples of additional suitable polymeric materials that can be used or included in the lacrosse heads include polypropylene (PP), polyethylene (PE), amorphous polar plastics (e.g., polycarbonate (PC)), polymethylmethacrylate (PMMA), polystyrene (PS), high impact polystyrene (HIPS), polyphenylene oxide (PPO), glycol modified polyethylene teraphthalate (PETG), acrylonitrile butadiene styrene (ABS), semicrystalline polar plastics (e.g., polyester PET and PBT), polyamide (nylon) (e.g., Nylon 6 and Nylon 6-6 (also called Nylon 6/6, Nylon 66 or Nylon 6,6), amorphous nylon, urethane, polyketone, polybutylene terephalate, acetals (e.g., DELRIN™ by DuPont), acrylic, acrylic-styrene-acrylonitrile (ASA), metallocene ethylene-propylene-diene terpolymer (EPDM) (e.g., NORDEL™ by DuPont), and composites thereof. In addition, fillers such as fiberglass, carbon fiber, mineral fill and the like can be added (for example 5-40% by weight) to create a custom polymeric composition.

As described herein, in embodiments the lacrosse head comprises a polymer, such as a nylon polymer, that exhibits greater than 50% light transmission. In further embodiments, the lacrosse head comprises a polymer, such as a nylon polymer, that exhibits greater than 60% light transmission, greater than 70% light transmission, greater than 75% light transmission, greater than 80% light transmission, greater than 85% light transmission, greater than 90% light transmission, or about 60% to about 90% light transmission, about 70% to about 90% light transmission, about 80% to about 90% light transmission, about 75% to about 85% light transmission, or about 80% to about 85% light transmission.

Light transmission can be measured by any suitable method, including for example via the use of a Window Tint Meter that measures light transmission from 0 to 100%. A Window Tint Meter is a hand held device that measures the amount of light that passes through a glass or polymeric structure. The meter can be held up to a sample of the polymers utilized to produce the lacrosse heads described herein and the percent (%) light transmission read off of the meter. The following provides an overview of the specifications of the meter used to measure light transmission:

TABLE 3

| Window Tint Meter Specifications | |
|---|---|
| Parameters: | |
| Display | 10 mm LCD |
| Measurement Range | 0 to 100% Light Transmission |
| Resolution | 0.1 |
| Accuracy | ±2% |

TABLE 3-continued

| Window Tint Meter Specifications | |
|---|---|
| Parameters: | |
| Sample Thickness | Less Than 18 mm/0.7 inch |
| Light Source | LED |
| Measuring Mode | Single/Continuous |
| Operating conditions | Temperature: 0~50° C. Humidity: <90% |
| Power Supply | 4 × 1.5 V AAA Size (UM-4) Battery |
| Dimensions | Unit: 126 × 65 × 27 mm (5.0 × 2.6 × 1.1 inch)<br>Sensor: 125 × 38 × 38 mm |
| Weight | 100 g (Not Including Batteries) |

Features:

This Window Tint Meter is a hand held device that measures the amount of light that passes through a window.

Technology is designed in accordance with GB 2410-80, ASTM D1033-61, JIS k7105-81 and other standards.

Digital display, wide measurement range, high resolution.

One key calibration, easy to use.

Solid structure, small volume, light-weight, exquisite, easy to carry.

Single/Continuous measuring mode.

Use "USB data output" and "RS-232 data output" to connect with PC.

Provide "Bluetooth ™ data output" choice.

In embodiments, the lacrosse head has a stiffness of less than 50 lbf, when measured at a temperature of between 70° F. and 75° F.

Figure 4A:
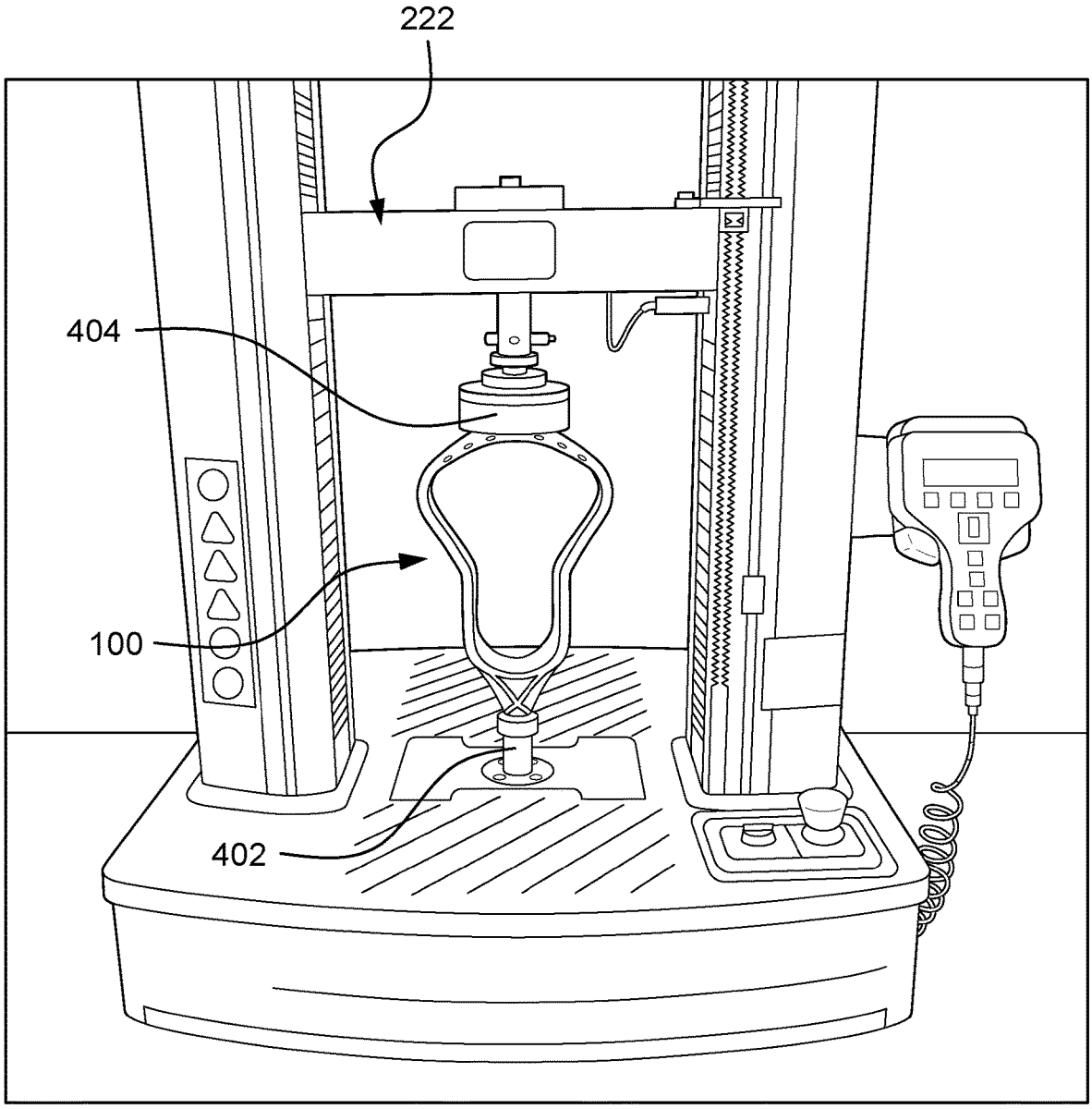
FIG. 4A shows the experimental set-up and device used to measure stiffness of a lacrosse head in accordance with embodiments hereof.

As described herein, "stiffness" also called "compression stiffness," refers to the force required to deflect a lacrosse head a distance of 0.25 inches, when the lacrosse head is pressed in a compressive manner when oriented vertically (compression is provided normal to scoop 208). See below and FIG. 4A regarding an exemplary stiffness measurement. The force to cause the 0.25 inch deflection varies only about over a temperature range of −15° C. to 52° C., and thus for comparison purposes, the stiffness of the lacrosse heads described herein are determined at a temperature of between about 70° F. and 75° F., suitably at about 71° F. or 72° F.

In embodiments, the stiffness of the lacrosse heads provided herein are less than about 40.0 lbf, when measured at a temperature of between 70° F. and 75° F., more suitably less than about 35.0 lbf, or less than about 33 lbf, or less than about 30 lbf, or less than about 27 lbf, or less than about 25 lbf, or less than about 23 lbf, or less than about 20 lbf, or less than about 10 lbf, or less than about 5 lbf, or the lacrosse heads have a stiffness of about 20 lbf to about 35 lbf, a stiffness of about 31 lbf to about 35 lbf, a stiffness of about 25 lbf to about 35 lbf, a stiffness of about 25 lbf to about 30 lbf; a stiffness of about 27 lbf to about 32 lbf, a stiffness of about 20 lbf to about 31 lbf, a stiffness of about 20 lbf to about 30 lbf, a stiffness of about 10 lbf to about 20 lbf, a stiffness of about 15 lbf to about 20 lbf, a stiffness of about 5 lbf to about 20 lbf, a stiffness of about 5 lbf to about 10 lbf, or a stiffness of about 15 lbf to about 25 lbf, when measured at a temperature of between 70° F. and 75° F.

In exemplary embodiments, the lacrosse head can withstand more than 150 impacts prior to failure.

As described in detail herein, an exemplary method has been developed to test the impact strength of a lacrosse head, that includes a repeated rotation of a lacrosse head impacting a spring-loaded, steel impact arm having a weight of about 2-4 lbs. Prior to each impact, the lacrosse head attains a kinetic energy of about 25-55 Joules, depending on the weight of the lacrosse head and variability in the speed of the impacts. That is, prior to each time the lacrosse head impacts the impact arm, the lacrosse head has attained a kinetic energy of about 25-55 Joules, and then impacts that impact arm, before again attaining the same kinetic energy range prior to another impact. See below and FIG. 3A regarding the exemplary testing method.

As described herein, this impact test is designed to provide a repeatable measure of the impact strength of a lacrosse head, so that different head designs and lacrosse head compositions can be compared. The number of impacts between the lacrosse head and the steel impact arm are counted. In embodiments, the lacrosse heads described herein can withstand more than 250 impacts (that is 250 contacts between the lacrosse head and the steel impact arm), prior to failure. As used herein "failure" refers to a visual crack or break 320 in the lacrosse head, rather than an elongation or plastic deformation 322 in the lacrosse head (see FIG. 3B).

A person of ordinary skill in the art will be able to calculate a kinetic energy that the lacrosse head attains prior to an impact, using standard physics principles. As described herein, the method used to determine the impact strength utilizes a rotating arm to impact the head against a steel impact arm, and thus rotational kinetic energy calculations are used to determine the kinetic energy the lacrosse head attains prior to each impact, of about 25-55 Joules.

In exemplary embodiments, the lacrosse heads described herein can withstand more than 5 impacts, more than 10 impacts, more than 15 impacts, more than 20 impacts, more than 25 impacts, more than 30 impacts, more than 35 impacts, more than 40 impacts, more than 50 impacts, more than 60 impacts, more than 70 impacts, more than 80 impacts, more than 90 impacts, more than 100 impacts, more than 110 impacts, more than 120 impacts, more than 130 impacts, more than 140 impacts, more than 150 impacts, more than 160 impacts, more than 170 impacts, more than 180 impacts, more than 190 impacts, more than 200 impacts, more than 210 impacts, more than 220 impacts, more than 230 impacts, more than 240 impacts, more than 250 impacts, more than 260 impacts, more than 270 impacts, more than 280 impacts, more than 290 impacts, more than 300 impacts, more than 400 impacts, more than 500 impacts, more than 600 impacts, more than 700 impacts, more than 800 impacts, more than 900 impacts, more than 1,000 impacts, more than 1,100 impacts, more than 1,200 impacts, more than 1,300 impacts, more than 1,400 impacts, or more than 1,500 impacts prior to failure, wherein the lacrosse head has attained a kinetic energy of about 25 Joules to about 55 Joules, prior to each impact.

Figure 3A:
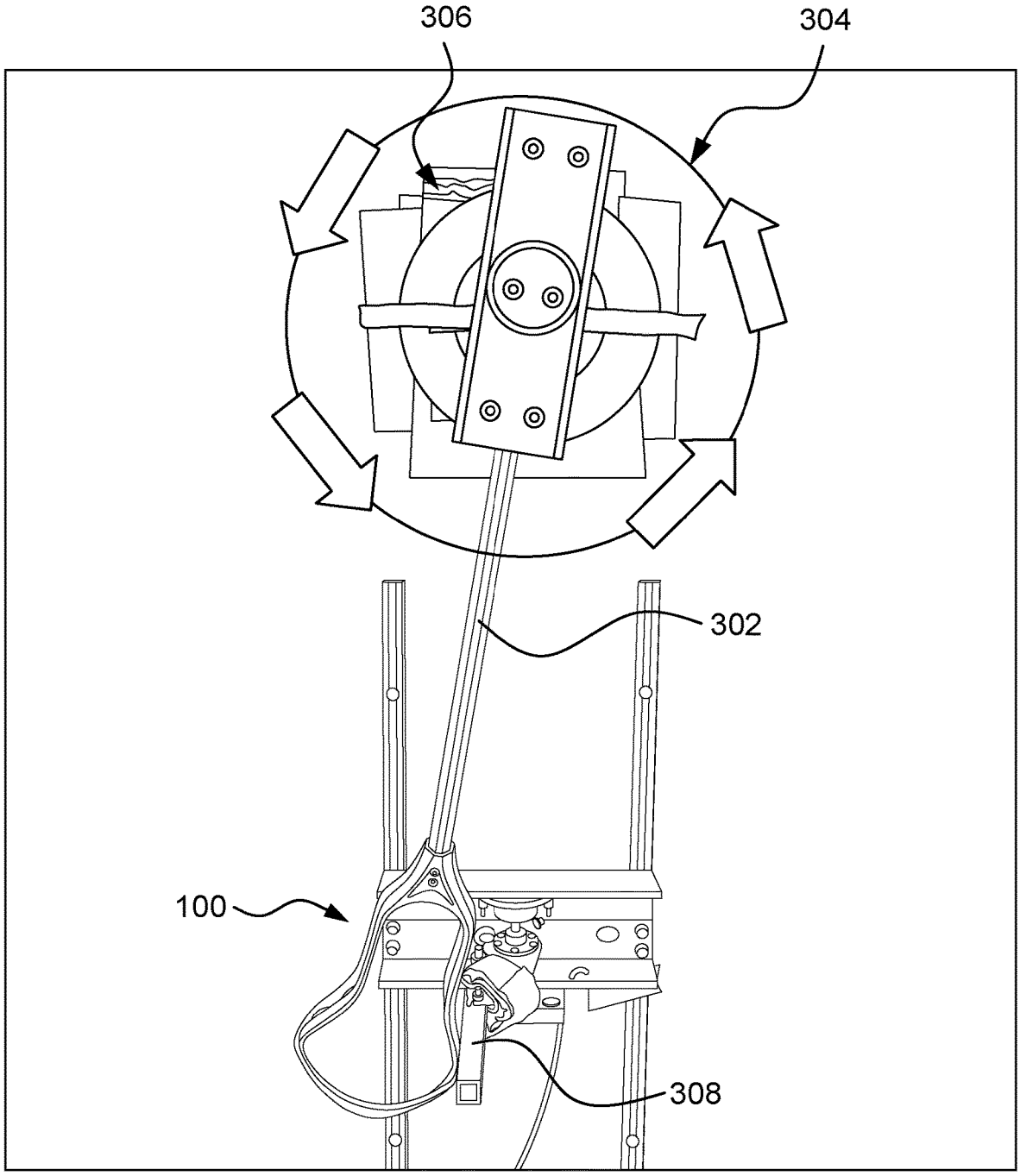
FIG. 3A shows the experimental set-up and device used in an impact test in accordance with embodiments hereof.
Figure 3B:
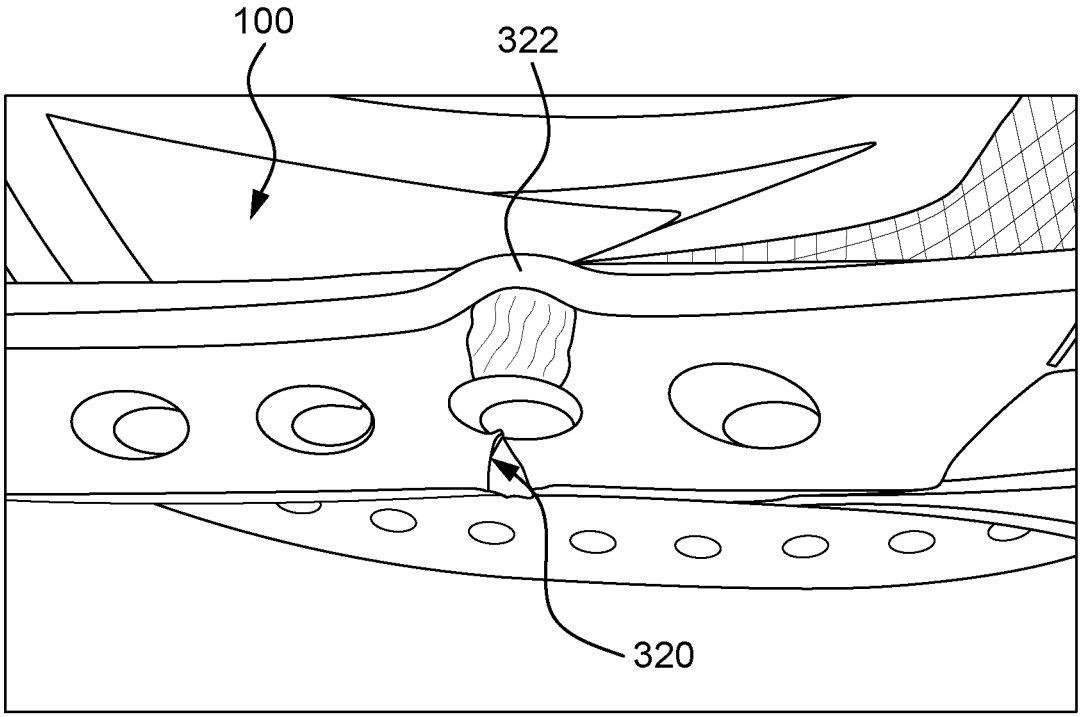
FIG. 3B shows a lacrosse head following an impact test.

In embodiments of this impact test as described herein with reference to FIG. 3A, lacrosse head 100 is attached to a shaft 302, the impact arm having a length of about 25-35 inches, suitably about 30 inches (center of point of rotation to impact bar). Shaft 302 is configured to rotate in a circular path 304, suitably via a rotating motor 306, or similar device.

Lacrosse head 100 is rotated in the circular path, suitably at a rate of about 20-25 m/s (at impact), and once during each rotation, lacrosse head 100 impacts a spring-loaded, steel impact arm 308. Suitably, spring-loaded, steel impact arm has a weight of about 2-4 lbs. Prior to each impact against spring-loaded, steel impact arm 308, lacrosse head 100 attains a kinetic energy of about 25 Joules to about 55 Joules. Following the impact, spring-loaded, steel impact arm 308, deflects out of the way, allowing lacrosse head 100 to continue on its circular path and repeat the impact test. The lacrosse head attains the same range of kinetic energy (about 25 to about 55 Joules) prior to each impact.

Suitably, the impact test is repeated at cycles of 10 impacts/cycle, before the test is started again. This also allows for repeatable and simple counting of the number of impacts until the lacrosse head fails, and to inspect the lacrosse head to determine if a failure has occurred.

As described herein, suitably the lacrosse head has a weight that is less than 200 g, more suitably less than 170 g, and in embodiments, the lacrosse head has a weight that is less than 160 g, less than 150 g, less than 140 g, less than 130 g, less than 120 g, less than 110 g, or in other embodiments, the weight of the lacrosse head is between 110 g and 170 g, more suitably between 110 g and 150 g, between 110 g and 140 g, between 110 g and 140 g, between 120 g and 125 g, between 120 g and 150 g, between 130 g and 150 g, or between 140 g and 150 g.

In exemplary embodiments, the lacrosse head has a stiffness of about 20 lbf to about 31 lbf when measured at a temperature between 70° F.-75° F., a weight of about 110 g to about 130 g, and the lacrosse head can withstand more than 150 impacts prior to failure, wherein the lacrosse head has attained a kinetic energy of about 25 Joules to about 55 Joules prior to each impact.

In further embodiments, the lacrosse head has a stiffness of about 5 lbf to about 20 lbf when measured at a temperature between 70° F.-75° F., a weight of about 100 g to about 125 g, and the lacrosse head can withstand more than 20 impacts prior to failure, when the lacrosse head has attained a kinetic energy of about 25 Joules to about 55 Joules prior to each impact.

In additional embodiments, provided herein is a lacrosse head comprising opposing sidewalls joined at one end by a throat, the sidewalls diverging generally outwardly, and the sidewalls being connected at another end by a scoop. Suitably, the lacrosse head comprises a polymer that exhibits greater than 60% light transmission, and the lacrosse head has a weight of about 110 g to about 150 g, a stiffness of about 20 lbf to about 35 lbf when measured at a temperature between 70° F.-75° F., and the lacrosse head can withstand more than 150 impacts prior to failure, wherein the lacrosse head has attained a kinetic energy of about 25 Joules to about 55 Joules prior to each impact, or the lacrosse head has a weight of about 100 g to about 125 g, a stiffness of about 5 lbf to about 20 lbf when measured at a temperature between 70° F.-75°, and wherein the lacrosse head can withstand more than 20 impacts prior to failure, wherein the lacrosse head has attained a kinetic energy of about 25 Joules to about 55 Joules prior to each impact.

In embodiments, the polymer exhibits greater than 75% light transmission. As described herein, suitably the polymer is an impact modified nylon, such as impact modified nylon 12.

In suitable embodiments, the lacrosse head can withstand more than 150 impacts prior to failure, wherein the lacrosse head has attained a kinetic energy of about 25 Joules to about 55 Joules prior to each impact.

In further embodiments, the lacrosse head has a weight of about 130 g to about 150 g, a stiffness of about 25 lbf to about 30 lbf when measured at a temperature between 70° F.-75° F., and the lacrosse head can withstand more than 200 impacts prior to failure, wherein the lacrosse head has attained a kinetic energy of about 25 Joules to about 55 Joules prior to each impact.

In still further embodiments, the lacrosse head has a weight of about 100 g to about 125 g, a stiffness of about 5 lbf to about 20 lbf when measured at a temperature between 70° F.-75° F., and the lacrosse head can withstand more than 30 impacts prior to failure, wherein the lacrosse head has attained a kinetic energy of about 25 Joules to about 55 Joules prior to each impact.

In additional embodiments, a lacrosse head provided herein is translucent, in that it exhibits a light transmission of about 10% to about 60%, and includes materials that contain a tint or coloring, but otherwise allow for the specified amount of light transmission. For example, provided herein is a lacrosse head comprising opposing sidewalls joined at one end by a throat, the sidewalls diverging generally outwardly, and the sidewalls being connected at another end by a scoop. Suitably the lacrosse head comprises a nylon polymer that exhibits about 15% to about 50% light transmission, and the lacrosse head has a weight of about 100 g to about 150 g, a stiffness of about 20 lbf to about 35 lbf when measured at a temperature between 70° F.-75° F., and the lacrosse head can withstand more than 150 impacts prior to failure, wherein the lacrosse head has attained a kinetic energy of about 25 Joules to about 55 Joules prior to each impact, or the lacrosse head has a weight of about 100 g to about 125 g, a stiffness of about 5 lbf to about 20 lbf when measured at a temperature between 70° F.-75° F., and the lacrosse head can withstand more than 20 impacts prior to failure, wherein the lacrosse head has attained a kinetic energy of about 25 Joules to about 55 Joules prior to each impact.

In embodiments, the lacrosse heads described herein that are translucent comprise a nylon polymer, such as an impact modified nylon, that exhibits about 18% to about 30% light transmission, and can include a tint, such as a brown, grey, black, green, blue, red, orange, or yellow tint.

In exemplary embodiments, the lacrosse head can withstand more than 200 impacts prior to failure, wherein the lacrosse head has attained a kinetic energy of about 25 Joules to about 55 Joules prior to each impact.

In further embodiments, the lacrosse head has a weight of about 130 g to about 150 g, a stiffness of about 25 lbf to about 30 lbf when measured at a temperature between 70° F.-75° F., and the lacrosse head can withstand more than 150 impacts prior to failure, wherein the lacrosse head has attained a kinetic energy of about 25 Joules to about 55 Joules prior to each impact.

In further embodiments, the lacrosse head has a weight of about 120 g to about 125 g, a stiffness of about 15 lbf to about 20 lbf when measured at a temperature between 70° F.-75° F., and wherein the lacrosse head can withstand more than 30 impacts prior to failure, wherein the lacrosse head has attained a kinetic energy of about 25 Joules to about 55 Joules prior to each impact.

In still further embodiments, provided herein is a lacrosse head comprising opposing sidewalls joined at one end by a throat, the sidewalls diverging generally outwardly, and the sidewalls being connected at another end by a scoop, the lacrosse head comprises an impact modified nylon 12 polymer that exhibits greater than 75% light transmission, and the lacrosse head has a weight of less than 150 g, a stiffness of less than 30.0 lbf when measured at a temperature between 70° F.-75° F., and wherein the lacrosse head can withstand more than 250 impacts prior to failure, wherein the lacrosse head has attained a kinetic energy of about 25 Joules to about 55 Joules prior to each impact.

In further embodiments, provided herein is a lacrosse head that is specifically designed for use by goalies, i.e., a goalie lacrosse head. In such embodiments, provided herein is a lacrosse head comprising: opposing sidewalls joined at one end by a throat, the sidewalls diverging generally outwardly, and the sidewalls being connected at another end by a scoop, wherein the lacrosse head comprises a polymer that exhibits greater than 60% light transmission, and wherein the lacrosse head has a weight of about 250 g to about 350 g, a stiffness of about 8 lbf to about 20 lbf when measured at a temperature between 70° F.-75° F., and wherein the lacrosse head can withstand more than 10 impacts prior to failure, wherein the lacrosse head has attained a kinetic energy of about 25 Joules to about 55 Joules prior to each impact.

Suitably, the weight of a goalie lacrosse head is greater than that of lacrosse heads for other position players, and thus, in such embodiments, the lacrosse head (goalie lacrosse head) has a weight of about 260 g to about 350 g, about 270 g to about 350 g, about 280 g to about 350 g, about 280 g to about 330 g, about 290 g to about 350 g, about 300 g to about 350 g, about 300 g to about 340 g, about 300 g to about 330 g, about 300 g to about 320 g, about 300 g to about 310 g, about 280 g to about 320 g, about 290 g to about 310 g, or about 290 g, about 291 g, about 292 g, about 293 g, about 294 g, about 295 g, about 296 g, about 297 g, about 298 g, about 299 g, about 300 g, about 301 g, about 302 g, about 303 g, about 304 g, about 305 g, about 306 g, about 307 g, about 308 g, about 309 g, or about 310 g.

As described herein, suitably the polymer used in the lacrosse head (goalie lacrosse head) exhibits greater than 75% light transmission, and in embodiments is an impact modified nylon. Suitably, the polymer comprises nylon 12. In further embodiments, the polymer comprises nylon 6, or nylon 6 and nylon 12, i.e., is a nylon 6/12 polymer, as described herein.

In embodiments, the lacrosse head (goalie lacrosse head) can withstand more than 100 impacts prior to failure, wherein the lacrosse head has attained a kinetic energy of about 25 Joules to about 55 Joules prior to each impact.

In further embodiments, the lacrosse head (goalie lacrosse head) has a weight of about 280 g to about 330 g, a stiffness of about 9 lbf to about 14 lbf when measured at a temperature between 70° F.-75° F., and wherein the lacrosse head can withstand more than 10 impacts prior to failure, wherein the lacrosse head has attained a kinetic energy of about 25 Joules to about 55 Joules prior to each impact. In additional embodiments, the lacrosse head can withstand more than 20 impacts prior to failure, more than 50 impacts prior to failure, more than 75 impacts prior to failure, more than 100 impacts prior to failure, more than 150 impacts prior to failure or more than 200 impacts prior to failure, wherein the lacrosse head has attained a kinetic energy of about 25 Joules to about 55 Joules prior to each impact

EXAMPLES

Example 1: Compression Stiffness

The following example describes the methods used to measure the compression stiffness (stiffness) of a lacrosse head.

Compression stiffness determinations are used in order to understand how flexible a lacrosse head is at a variety of temperatures. The stiffness of a lacrosse head is one of the first things lacrosse players check. Many players want a stiff head while others prefer a more flexible head.

Figure 4C:
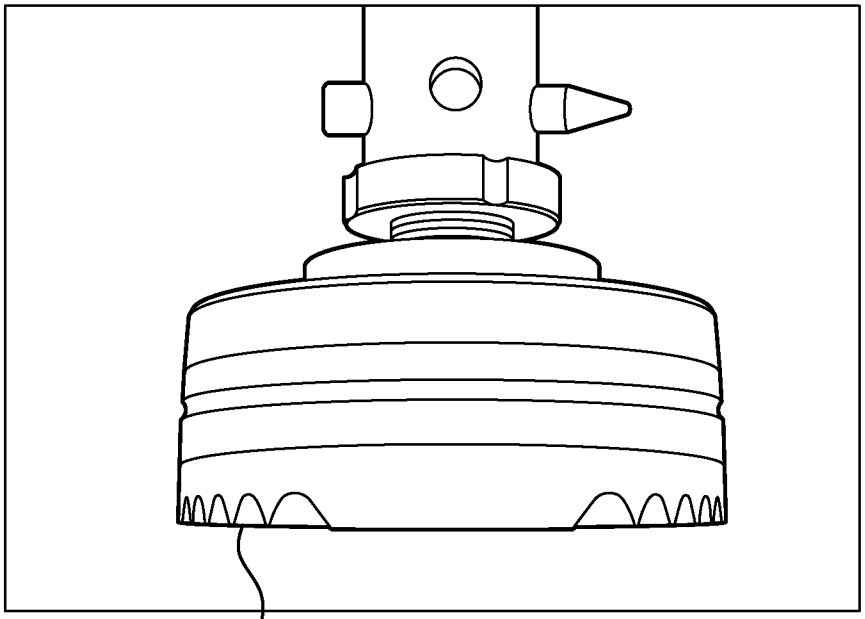
FIGS. 4B-4C show components used in the stiffness measurements described herein.
Figure 4B:
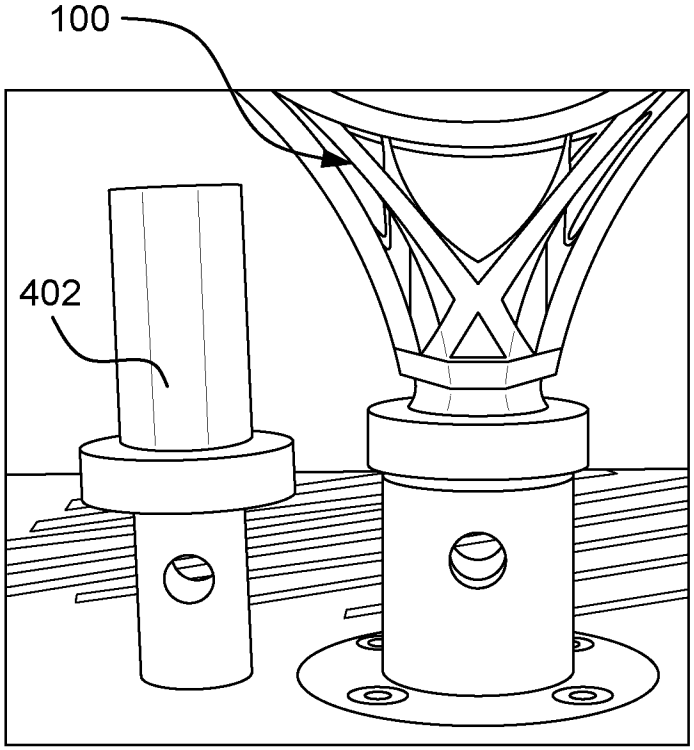

Equipment
- MTS Exceed Model E43 (see FIG. 4A)
- Custom 3D Printed Attachments
  - Lacrosse Head Coupling (402) (see FIG. 4B)
  - Grooved Pressure Plate Attachment (404) (see FIG. 4C)
- Infrared Laser Thermometer Environment
- Temperature: 22° C. (71.6° F.)
- Humidity: 50% (+/−10%)

Procedure
- Turn MTS on and start software.
- Place lacrosse head 100 on MTS using custom coupling 402.
- Select the "Head Flexibility Test" in the software.
- Lower crosshead 222 on MTS until a pre-load of 0.5 lbf on lacrosse head 100 is reached.
- Start test, with increasing force (pounds force, lbf; perpendicular to lacrosse head 100) until a 0.25" deflection in the lacrosse head is reached.
- Continue testing head and record stiffness.

Example 2: Impact Testing

The following example describes the methods used to measure the impact durability (or strength) of a lacrosse head. If a lacrosse head survives a predetermined amount of cycles (generally 300 cycles) it is considered ready for play. The test also provides competitive matrices from the data collected.

Equipment
- Thor XL (custom built—see FIG. 3A)

Environment
- Temperature: 22° C. (71.6° F.)
- Humidity: 50% (+/−10%)

Materials and Specs
- 3-Phase Induction Motor (306) (IronHorse model #MTCP-001-3BD12)
- Impact Arm (308) (McMaster-Carr Part #6527K364)
  - Steel
  - Weight—2.8 lbs. (including flange and fasteners)
  - Height—1"
  - Width—1"
  - Length—1'
- Torsion Spring (308) (McMaster-Carr Part #9271K126)

TABLE 4

Torsion Spring Characteristics

| | | | |
|---|---|---|---|
| Spring Type | Torsion | Leg Length | 4" |
| Deflection Angle | 180° | Number of Coils | 9 |
| Wind Direction | Right-Hand | Spring Length @ Maximum Torque | 1.553" |
| OD | 1.189" | Maximum Torque | 42.86 in.-lbs. |
| For Shaft Diameter | 0.735" | Material | Music-Wire Steel |
| Wire Diameter | 0.135" | RoHS | Compliant |

- AC Drive (GS2 Series Drive Model GS2-11P0)
- Frequency—50 hz (Velocity at impact is 50 mph±5 mph (22.4 m/s±2.2 m/s)
- Titanium Shaft (302) to hold lacrosse head
- 30" radius from center axis of motor (306) and impact arm (308).

Procedure
- Place a lacrosse head on shaft and screw into place.
- Turn on and release the E-stop.
- Press the "10 Cycle" button.
- Record the # of hits.
- Continue testing and observing until the lacrosse head fails (defined as a visual crack, fracture or break (320 in FIG. 3B), not a plastic deformation or elongation (322 in FIG. 3B)).

Stop test after head reaches the desired number of minimum impacts (suitably 100-300).

Record the number of impacts along with a pass/fail grade.

**Additional testing can go beyond the minimum number of impacts in order to reach failure to understand the limits of different types of heads and materials.

Results

Pass Criteria: Head survives 100 impacts (or higher, e.g., 300 impacts) without breaking for men's lacrosse head; 20 impacts or higher without breaking for women's lacrosse head.

Fail Criteria: Head breaks before 100 impacts (or lower, e.g., 40 impacts, 30 impacts, 20 impacts, depending on desired impact resistance for the men's or women's game). Heads are also taken beyond 250 impacts to determine the ultimate number of impacts that can be withstood prior to failure.

Table 4 shows the calculation of the kinetic energy of the lacrosse head prior to impact between the lacrosse head and the spring-loaded, steel impact beam. A range of linear velocities was used to provide general ranges for the kinetic energy. In addition, several different lacrosse head styles were included, with different masses, to provide a range for the kinetic energy of the lacrosse head during the impact testing. As indicated, the range of kinetic energies of the lacrosse head prior to each impact is from about 25 Joules to about 55 Joules.

TABLE 5

Kinetic Energy Calculation for Impact Testing

Test Instrument Characteristics

| | |
|---|---|
| Shaft (302 in FIG. 3A) Radius | 0.762 m |
| Linear Velocity (low) | 20.11677 m/s |
| Linear Velocity (mid) | 22.35196 m/s |
| Linear Velocity (high) | 24.58716 m/s |

Kinetic Energy Calculations

| Lacrosse Head Design | Mass (kg) | Velocity (m/s) | Radius (m) | Angular Velocity (rad/s) ($\omega$ = Velocity/ Radius) | Mass Moment of Inertia (kg $m^2$) I = Mass* $Radius^2$ | Rotational Kinetic Energy (Joules) $KE_{rot}$ = 1/2* I*$\omega^2$ |
|---|---|---|---|---|---|---|
| Rebel - O | 0.139 | 20.117 | 0.762 | 26.400 | 0.0807 | 28.126 |
| Rebel - O | 0.139 | 22.35196 | 0.762 | 29.333 | 0.0807 | 34.723 |
| Rebel - O | 0.139 | 24.58716 | 0.762 | 32.267 | 0.0807 | 42.015 |
| Rebel - O | 0.145 | 20.117 | 0.762 | 26.400 | 0.0842 | 29.340 |
| Rebel - O | 0.145 | 22.35196 | 0.762 | 29.333 | 0.0842 | 36.222 |
| Rebel - O | 0.145 | 24.58716 | 0.762 | 32.267 | 0.0842 | 43.828 |
| Rebel - O | 0.156 | 20.117 | 0.762 | 26.400 | 0.0906 | 31.565 |
| Rebel - O | 0.156 | 22.35196 | 0.762 | 29.333 | 0.0906 | 38.970 |
| Rebel - O | 0.156 | 24.58716 | 0.762 | 32.267 | 0.0906 | 47.153 |
| Rebel - O | 0.159 | 20.117 | 0.762 | 26.400 | 0.0923 | 32.172 |
| Rebel - O | 0.159 | 22.35196 | 0.762 | 29.333 | 0.0923 | 39.719 |
| Rebel - O | 0.159 | 24.58716 | 0.762 | 32.267 | 0.0923 | 48.060 |
| Rebel - O | 0.156 | 20.117 | 0.762 | 26.400 | 0.0906 | 31.565 |
| Rebel - O | 0.156 | 22.35196 | 0.762 | 29.333 | 0.0906 | 38.970 |
| Rebel - O | 0.156 | 24.58716 | 0.762 | 32.267 | 0.0906 | 47.153 |
| Rebel - O | 0.153 | 20.117 | 0.762 | 26.400 | 0.0888 | 30.958 |
| Rebel - O | 0.153 | 22.35196 | 0.762 | 29.333 | 0.0888 | 38.220 |
| Rebel - O | 0.153 | 24.58716 | 0.762 | 32.267 | 0.0888 | 46.246 |
| Mirage | 0.131 | 20.117 | 0.762 | 26.400 | 0.0761 | 26.507 |
| Mirage | 0.131 | 22.35196 | 0.762 | 29.333 | 0.0761 | 32.724 |
| Mirage | 0.131 | 24.58716 | 0.762 | 32.267 | 0.0761 | 39.597 |
| Mirage | 0.147 | 20.117 | 0.762 | 26.400 | 0.0854 | 29.744 |
| Mirage | 0.147 | 22.35196 | 0.762 | 29.333 | 0.0854 | 36.721 |
| Mirage | 0.147 | 24.58716 | 0.762 | 32.267 | 0.0854 | 44.433 |
| Mirage | 0.147 | 20.117 | 0.762 | 26.400 | 0.0854 | 29.744 |
| Mirage | 0.147 | 22.35196 | 0.762 | 29.333 | 0.0854 | 36.721 |
| Mirage | 0.147 | 24.58716 | 0.762 | 32.267 | 0.0854 | 44.433 |
| Rebel - D | 0.174 | 20.117 | 0.762 | 26.400 | 0.1010 | 35.208 |
| Rebel - D | 0.174 | 22.35196 | 0.762 | 29.333 | 0.1010 | 43.466 |
| Rebel - D | 0.174 | 24.58716 | 0.762 | 32.267 | 0.1010 | 52.594 |
| Rebel - D | 0.174 | 20.117 | 0.762 | 26.400 | 0.1010 | 35.208 |
| Rebel - D | 0.174 | 22.35196 | 0.762 | 29.333 | 0.1010 | 43.466 |
| Rebel - D | 0.174 | 24.58716 | 0.762 | 32.267 | 0.1010 | 52.594 |

Example 3: Development and Testing of Clear and Translucent Lacrosse Heads

Background

Prior attempts to create clear lacrosse heads focused on using several thermoplastics, including polycarbonate, thermoplastic polyurethane (TPU) and amorphous polyamides. The resulting heads were not acceptable for the following reasons:

Polycarbonate—Clear, but with resulting head exhibiting low durability, heavy and very stiff TPU—Cloudy appearance with resulting head exhibiting very low durability and high flexibility.

Amorphous Polyamide—Clear with very yellow tint, resulting head exhibiting low durability, high stiffness and difficult to process.

The issues to overcome, included balancing minimum durability requirements versus optical clarity. However, an increase in impact modifier to boost durability, can have a detrimental effect on optical clarity and stiffness.

Impact Modified Nylon

A transition to impact modified nylon resulted in the desired optical clarity characteristics, while also achieving the needed material characteristics for optimal playability.

Manufacturing of the lacrosse heads with the impact modified nylon utilized "packing out" (pushing more plastic into the part) to the maximum extent possible, to optimize the desired mechanical characteristics. Parts that are more packed are heavy, which is often not desired, and can cause flash (sharp plastic) on the part surface. It can also be very hard on the injection molding press. Packing of the parts to the maximum extent possible, well beyond the calculated weight, was carried out. The increased pack out pressure acts to increase the strength of knit lines. Knit lines are created when plastic flows around geometric features in parts. Knit line strength is very critical to durability.

As shown in the Table 5 below, the clear lacrosse head part weights were >4-7% heavier than the calculated weight (due to packing out), and achieved the durability desired for play. This extra pack out minimizes the benefits of the lower specific gravity of the impact modified nylon material in exchange for durability. It was surprising and unexpected that use of packing out resulted in the desired playability characteristics, while still maintaining a manageable weight and the optical clarity of the lacrosse head.

TABLE 6

Calculated weight versus Actual weights of Impact Modified Nylon (IMN)

| Lacrosse Head Geometry | Production Material | Material Specific Gravity | Production Weight (g) | Impact modified nylon specific gravity | % difference in S.G. | IMN Weight (calc. by % diff.) | IMN Weight (Actual) | % diff. in IMN weight (Actual vs Calc.) |
|---|---|---|---|---|---|---|---|---|
| DNA | PolySource Integra 9060 (Polyketone) | 1.24 | 170.7 g | 1.00 | 80.65% | 137.67 g | 146.5 g | 106.41% |
| Mirage 2 | RTP 200H (Impact modified Nylon 6) | 1.08 | 141.5 g | 1.00 | 92.59% | 131.01 g | 140 g | 106.86% |
| Infinity | RTP 200H (Impact modified Nylon 6) | 1.08 | 128.1 g | 1.00 | 92.59% | 118.61 g | 123.5 g | 104.12% |

Performance Results

DNA Lacrosse Head Geometry

DNA lacrosse head geometry trials utilizing the impact modified nylon demonstrated the desired mechanical characteristics for a playable lacrosse head. See FIG. 5. As shown, without packing out the lacrosse head with the impact modified nylon (see DNA Head), the lacrosse head had a weight of about 140 g, and a stiffness of about 26 lbf at 72° F., but failed the impact test, breaking at the back strut after 240 impacts. Packing out the lacrosse head with the impact modified nylon (see DNA Diamond) resulted in a lacrosse head that was able to withstand an acceptable 290 hits without breaking, and have a weight of about 146.5 g, and a stiffness of between 27-29 lbf.

Mirage 2 Lacrosse Head Geometry

Mirage 2 lacrosse head geometry trials utilizing the impact modified nylon demonstrated the desired mechanical characteristics for a playable lacrosse head. See FIG. 6. Packing out the lacrosse head with the impact modified nylon resulted in a lacrosse head that was able to withstand an acceptable 240 hits without breaking, and have a weight of about 140.9 g, and a stiffness of about 27.6 lbf.

Infinity Lacrosse Head Geometry

Infinity lacrosse head geometry trials (a lacrosse head for use in women's lacrosse) comprising the impact modified nylon demonstrated the desired mechanical characteristics for a playable lacrosse head. See FIG. 7. Packing out the lacrosse head with the impact modified nylon resulted in a lacrosse head that was able to withstand an acceptable 25 hits without breaking, and have a weight of about 124.1 g, and a stiffness of about 16.2 lbf at 72° F.

Optical Clarity Results

In order to determine the level of light transmission, a Window Tint Meter which measures between 0% to 100% light transmission was utilized. Device specifications are provided above.

Figure 8:
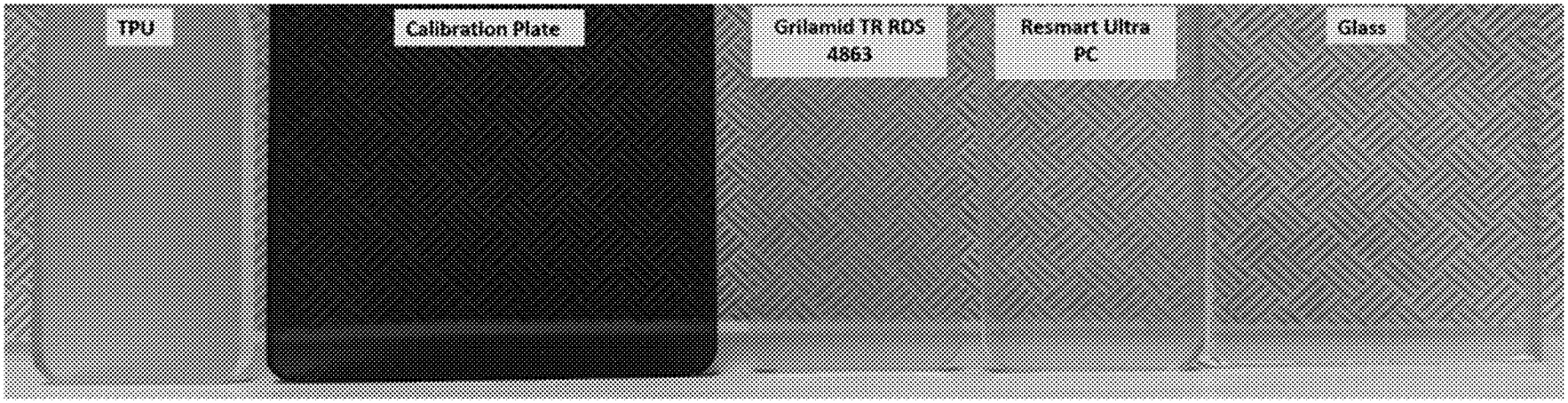
FIG. 8 shows reference photographs of materials measured using a window tint meter.

Utilizing this device, light transmission measurements were made through several plastic samples, including a device calibration plate (provided with unit) and clear glass. The light transmission of each material is noted in Table 6. A side by side reference photograph of the materials is provided in FIG. 8.

TABLE 7

Light Transmission Measurements

| Material | Light Transmission (%) |
|---|---|
| Glass | 95.6 |
| Resmart Ultra PC | 84.9 |
| Grilamid TR RDS 4863 | 81.3 |
| Calibration Plate | 18.6 |
| TPU | 17.2 |

As indicated, the impact modified nylon product GRILAMID® TR RDS 4863, demonstrated a light transmission of about 81.3%.

Performance of Other Optically Clear Materials

Resmart Ultra PC, a polycarbonate material, was molded into the DNA geometry. The DNA Ultra PC provides a comparison for clarity and durability versus the DNA Diamond (GRILAMID® TR RDS 4863). The results of the DNA Ultra PC (polycarbonate) are provided in FIG. 9. As indicated, while the polycarbonate version of the DNA exhibits higher light transmission, the playability characteristics are lower than the DNA Diamond. The weight of the DNA head using the polycarbonate material was significantly higher (about 169 g) than the impact modified nylon, an undesirable characteristic. In addition, the polycarbonate material resulted in a much higher stiffness (41.7 lbf), and was only able to withstand 50 impact hits prior to failure. These characteristics are not acceptable for a lacrosse head for use in men's lacrosse. See FIG. 5 for mechanical characteristics of the DNA Diamond head comprising impact modified nylon.

The Ultra PC polycarbonate material was also used to prepare an Infinity lacrosse head, to explore its characteristics as a lacrosse head for use in women's lacrosse. As shown in FIG. 10, while the lacrosse head did have a higher light transmission, it had significantly greater weight (147.9 g), much higher stiffness (27 lbf), and failed after less than 10 impacts (very low durability). All of these characteristics are not optimal for use in a head for women's lacrosse, in contrast to the characteristics observed with the impact modified nylon of the Diamond lacrosse head (see FIG. 7)

In summary, these results demonstrate the surprising and unexpected mechanical properties of the optically clear lacrosse heads described herein.

Example 4: Development and Testing of Clear and Translucent Goalie Lacrosse Heads Goalie lacrosse heads are prepared in accordance with the methods described herein. The resulting characteristics of the goalie lacrosse head are determined as described herein:

TABLE 8

Goalie Lacrosse Head Characteristics

| Specification | Determined |
|---|---|
| Weight | 308 g; 299 g; 301 g; 319 g |
| Scoop Stiffness (72° F.) | 9.8 lbf; 8.67 lbf; 8.6 lbf; 9.47 lbf |
| Top Stiffness (72° F.) | 11.85 lbf; 10.9 lbf; 11.03 lbf; 13.37 lbf |
| Top Stiffness (72° F.; conditioned[1]) | 10.97 lbf; 10.9 lbf; 11.03 lbf; 13.37 lbf |
| Top Stiffness (105° F.) | ~6 lbf |

[1]Conditioned refers to stiffness measured after several weeks or months maintained at room temperature, to gauge the response of the polymeric material after exposure to humidity.

The Goalie heads were able to withstand greater than 100 hits, approaching 300 hits, prior to failure when tested using the Thor XL.

The breadth and scope of the present invention should not be limited by any of the above-described exemplary embodiments, but should be defined only in accordance with the appended claims and their equivalents. It will also be understood that each feature of each embodiment discussed herein, and of each reference cited herein, can be used in combination with the features of any other embodiment. All patents and publications discussed herein are incorporated by reference herein in their entirety.

What is claimed is:

1. A process for manufacturing a lacrosse head, comprising:

injecting an impact modified nylon 12 thermoplastic polyamide polymer into a lacrosse head mold, wherein the injecting utilizes packing out of the mold, resulting in a lacrosse head having opposing sidewalls joined at one end by a throat, the sidewalls diverging generally outwardly, and the sidewalls being connected at another end by a scoop; and wherein the lacrosse head has a stiffness of less than 40.0 lbf when measured at a temperature between 70° F.-75° F., a weight of about 110 g to about 170 g, and about 50% to about 90% of light passes through the lacrosse head, wherein the packing out of the mold increases the weight of the lacrosse head by about 4% to about 7% relative to the lacrosse head calculated weight based on the weight of the impact modified nylon 12 thermoplastic polyamide polymer without the packing out of the mold.

2. The process of claim 1, wherein the weight is about 110 g to about 150 g.

3. The process of claim 1, wherein about 60% to about 90% of light passes through the lacrosse head.

4. The process of claim 1, wherein the stiffness is about 20 lbf to about 31 lbf when measured at a temperature between 70° F.-75° F.

5. The process of claim 1, wherein the impact modified nylon 12 thermoplastic polyamide polymer has a specific gravity of about 1.00.

6. The process of claim 1, wherein the stiffness is about 5 lbf to about 20 lbf when measured at a temperature between 70° F.-75° F., and the weight is about 100 g to about 130 g.

7. A process for manufacturing a lacrosse head, comprising:

injecting an impact modified nylon 12 thermoplastic polyamide polymer into a lacrosse head mold, wherein the injecting utilizes packing out of the mold, resulting in a lacrosse head having opposing sidewalls joined at one end by a throat, the sidewalls diverging generally outwardly, and the sidewalls being connected at another end by a scoop; and wherein the lacrosse head has a stiffness of about 5 lbf to about 30 lbf when measured at a temperature between 70° F.-75° F., a weight of about 110 g to about 150 g, and about 50% to about 90% of light passes through the lacrosse head, wherein the packing out of the mold increases the weight of the lacrosse head by about 4% to about 7% relative to the lacrosse head calculated weight based on the weight of the impact modified nylon 12 thermoplastic polyamide polymer without the packing out of the mold.

8. A process for manufacturing a lacrosse head, comprising:

injecting an impact modified nylon 12 thermoplastic polyamide polymer into a lacrosse head mold, wherein the injecting utilizes packing out of the mold, resulting in a lacrosse head having opposing sidewalls joined at one end by a throat, the sidewalls diverging generally outwardly, and the sidewalls being connected at another end by a scoop; and wherein the lacrosse head has a stiffness of about 20 lbf to about 35 lbf when measured at a temperature between 70° F.-75° F., a weight of about 130 g to about 150 g, and about 50% to about 90% of light passes through the lacrosse head, wherein the packing out of the mold increases the weight of the lacrosse head by about 4% to about 7% relative to the lacrosse head calculated weight based on the weight of the impact modified nylon 12 thermoplastic polyamide polymer without the packing out of the mold.

* * * * *